US008403043B2

(12) United States Patent
Khan et al.

(10) Patent No.: US 8,403,043 B2
(45) Date of Patent: Mar. 26, 2013

(54) MICROWAVE-PROMOTED DESULFURIZATION OF CRUDE OIL

(75) Inventors: Rashid M. Khan, Dhahran (SA); Emad Naji Al-Shafei, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 289 days.

(21) Appl. No.: 12/742,151

(22) PCT Filed: Nov. 14, 2008

(86) PCT No.: PCT/US2008/012859

§ 371 (c)(1), (2), (4) Date: Jul. 22, 2010

(87) PCT Pub. No.: WO2009/064501

PCT Pub. Date: May 22, 2009

(65) Prior Publication Data

US 2010/0288494 A1 Nov. 18, 2010

Related U.S. Application Data

(60) Provisional application No. 61/003,208, filed on Nov. 14, 2007.

(51) Int. Cl.

| | |
|---|---|
| ***C10G 32/02*** | (2006.01) |
| ***C10G 33/02*** | (2006.01) |
| ***C10G 49/04*** | (2006.01) |
| ***E21B 43/34*** | (2006.01) |
| ***E21B 43/38*** | (2006.01) |

(52) U.S. Cl. ..... 166/267; 208/187; 208/209; 208/213; 208/216 R; 208/217; 208/236

(58) Field of Classification Search ..... None
See application file for complete search history.

(56) References Cited

U.S. PATENT DOCUMENTS

| | | | | |
|---|---|---|---|---|
| 4,087,348 | A | 5/1978 | Baird, Jr. et al. | |
| 4,148,614 | A | 4/1979 | Kirkbride | |
| 4,234,402 | A | 11/1980 | Kirkbride | |
| 4,279,722 | A | 7/1981 | Kirkbride | |
| 4,405,825 | A * | 9/1983 | Fenton et al. | 585/13 |
| 4,545,879 | A | 10/1985 | Wan et al. | |
| 4,582,629 | A | 4/1986 | Wolf | |
| 4,749,470 | A | 6/1988 | Herbst et al. | |
| 4,810,375 | A | 3/1989 | Hudgins et al. | |
| 4,853,119 | A | 8/1989 | Wolf et al. | |
| 4,853,507 | A | 8/1989 | Samardzija | |
| 4,889,639 | A | 12/1989 | Hudgins et al. | |
| 5,055,180 | A | 10/1991 | Klaila | |
| 5,181,998 | A | 1/1993 | Murphy et al. | |
| 5,591,326 | A * | 1/1997 | Shih | 208/251 R |
| 5,911,885 | A | 6/1999 | Owens | |

(Continued)

OTHER PUBLICATIONS

Supplementary European Search Report for counterpart EPO application 08850519.3 (PCT/US2008/012859).

(Continued)

*Primary Examiner* — George Suchfield
(74) *Attorney, Agent, or Firm* — Abelman, Frayne & Schwab

(57) ABSTRACT

Heavy crude oils having high sulfur content and viscosities are upgraded by a hydrodesulfurization (HDS) process that includes microwave irradiation of a mixture of the sour heavy crude oil with at least one catalyst and optionally, one or more sensitizers, and irradiation in the presence of hydrogen. The process is also adapted to microwave treatment of hard to break emulsions, either above ground or below ground where water-in-oil emulsions are initially formed, followed by the catalytic hydrodesulfurization promoted by application of further microwave energy to the demulsified crude oil stream.

23 Claims, 2 Drawing Sheets

U.S. PATENT DOCUMENTS

| | | | | |
|---|---|---|---|---|
| 5,914,014 | A | 6/1999 | Kartchner | |
| 6,017,845 | A | 1/2000 | Ovalles et al. | |
| 6,068,737 | A | 5/2000 | De Chamorro et al. | |
| 6,077,400 | A * | 6/2000 | Kartchner | 204/157.15 |
| 6,086,830 | A | 7/2000 | Kartchner | |
| 6,171,479 | B1 | 1/2001 | Ovalles et al. | |
| 6,200,927 | B1 | 3/2001 | Shukis et al. | |
| 6,239,054 | B1 | 5/2001 | Shukis et al. | |
| 6,291,394 | B1 | 9/2001 | Shukis et al. | |
| 6,451,174 | B1 | 9/2002 | Burkitbaev | |
| 6,555,009 | B2 | 4/2003 | Varadaraj | |
| 6,716,358 | B2 | 4/2004 | Varadaraj | |
| 6,797,126 | B2 * | 9/2004 | Sharivker et al. | 204/157.15 |
| 6,824,746 | B2 | 11/2004 | Ayukawa et al. | |
| 6,994,774 | B2 | 2/2006 | Burkitbaev | |
| 7,150,836 | B2 | 12/2006 | Meikrantz | |
| 7,157,401 | B2 | 1/2007 | Purta et al. | |
| 2004/0031731 | A1 | 2/2004 | Honeycutt | |
| 2004/0074759 | A1 | 4/2004 | Purta | |
| 2005/0252833 | A1 | 11/2005 | Doyle et al. | |
| 2007/0087933 | A1 * | 4/2007 | Purta et al. | 502/5 |
| 2009/0166028 | A1 * | 7/2009 | Varadaraj et al. | 166/244.1 |
| 2009/0200213 | A1 * | 8/2009 | Varadaraj et al. | 209/5 |
| 2011/0094378 | A1 * | 4/2011 | Mitariten | 95/50 |
| 2011/0226670 | A1 * | 9/2011 | Cullen | 208/212 |

OTHER PUBLICATIONS

Gunal et al., "Alteration of Asphaltic Crude Rheology with Electromagnetic and Ultrasound Irradiation", Journal of Petroleum Science and Engineering 2000, 26, 263-272.

Zaykin et al., "Radiation Thermal Conversion of Paraffinic Oil", Radiation Physics and Chemistry, 2004, 69, 229-238.

Zaykin et al., "Prospects for Irradiation Processing in the Petroleum Industry", Radiation Physics and Chemistry, 2002, 63, 617-620.

PCT/US08/12859 International Search Report and Written Opinion, Jan. 12, 2009, 6 pages.

* cited by examiner

MICROWAVE-PROMOTED DESULFURIZATION OF CRUDE OIL

RELATED APPLICATIONS

The present application is a United States national phase application under 35 USC §371 of PCT/US08/12859 filed on Nov. 14, 2008, which claims priority to U.S. Provisional Patent Application 61/003,208 filed on Nov. 14, 2007, both of which are incorporated by reference in their entireties in the present application.

FIELD OF THE INVENTION

This invention relates to the processing of crude oil using microwave energy to reduce the sulfur content.

BACKGROUND OF THE INVENTION

The sulfur content of heavy crude oil varies from 0.1 to 15 percent. This is mostly in the form of high molecular weight organic sulfur compounds, and any dissolved elemental sulfur and/or hydrogen sulfide represent only a small part of the total sulfur. The sulfur-containing compounds in crude oil include the following: sulfides, disulfides, mercaptans (thiophenes), benzothiophenes, dibenzothiopenes, benzonaphthothiophenes, and dinaphthothiophenes. The structures of these compounds are well known. The desulfurization of crude oil is an important preliminary step to improve the quality and yield of gasoline products. The current methods of desulfurization utilized in the chemical industry have fundamental limitations, such as the cost of energy and material consumption, severe processing conditions and the use of expensive catalysts. Processes that include microwave irradiation have also been disclosed in the prior art.

A principal purpose of hydrodesulfurization (HDS) is to improve the quality of the heavy crude oil to meet the required specifications for its particular use. Depending on the process conditions, the HDS process can be classified as "destructive" or "non-destructive". The destructive HDS process is characterized by molecular fragmentation and hydrogenation saturation of the fragments to produce lower boiling fractions, and the non-destructive HDS process requires milder conditions, generally referred to as hydrotreating, and provides a means of removing simple sulfur compounds.

The effect of the HDS process is to convert the organic sulfur in the heavy crude to hydrogen sulfide as illustrated below:

$$\text{Heavy crude}_{sulfur}+H_2 \rightarrow H_2S+\text{Heavy crude}_{sulfur\ deficient}$$

This reaction is characterized by destructive hydrogenation which requires carbon-carbon bond cleavage and subsequent hydrogen saturation of the fragments leading to improved product quality through hydrodesulfurization and production of lower boiling point products. The process conditions require high temperatures and pressures, a catalyst and high hydrogen-to-crude oil feed ratios.

Application of radiation chemistry in the oil industry gained prominence in the early 1960's when only light hydrocarbon substances were used as models in radiation processing experiments. Radiation was deemed to be relatively expensive then and it was not until the 1990's that the technology referred to as hydrocarbon enhancement electron-beam technology (HEET) was developed. More recently, microwave irradiation has been used in the petroleum industry for inspecting coiled tubing and line pipe, measuring multiphase flow, and the mobilization of asphaltic crude oil.

Gunal and Islam observed the permanent alteration of asphaltenes in the colloidal structures of the molecules and an increase in viscosity when exposed to microwave irradiation, due to the reorientation of molecular structures rather than thermal breakdown. "Alteration of Asphaltic Crude Rheology with Electromagnetic and Ultrasound Irradiation," *Journal of Petroleum Science and Engineering* 2000, 26, 263-272. It was noted that when exposed to electromagnetic radiation, the presence of alsphaltenes caused permanent changes in crude oil rheology due to the polar nature of asphaltene molecules. Zaykin, et al. reported evidence of extensive branching and breaking of the paraffin chain during irradiation of paraffinic oil. "Radiation Thermal Conversion of Paraffinic Oil," *Radiation Physics and Chemistry,* 2004, 69, 229-238; "Prospects for Irradiation Processing in the Petroleum Industry," *Radiation Physics and Chemistry,* 2002, 63, 617-620.

In the microwave irradiation process, it is difficult to meet the requirements of the HDS destructive process due to its low energy, particularly in the absence of sensitizers. The prevailing conditions in the microwave process generally favor non-destructive HDS due to the low temperature conditions obtainable with microwave irradiation. Since crude oil absorbs little microwave radiation, sensitizers and other polar solvents can be used to improve its absorption. In the case of a water in crude oil emulsion, the retained water in the crude oil functions as the primary microwave energy absorber.

As a method of desulfurization, microwave heating has been recognized as providing advantages such as short start-up time, rapid heating, energy efficiency and precise process control. Through the use of microwave energy with additives, hydrocarbons high in sulfur content and/or composed of primarily heavy hydrocarbons can be made into useful commercial products which can be burned cleanly and efficiently as a fuel oil, as described in the following patents that disclose the use of microwave irradiation: U.S. Pat. No. 4,148,614, Apr. 10, 1979; U.S. Pat. No. 4,749,470, Jun. 7, 1988; U.S. Pat. No. 6,824,746; and U.S. Pat. No. 4,279,722, Nov. 15, 1994.

The use of microwave energy to demulsify otherwise hard to break emulsions of oil and water is also known to the art. These emulsions are commonly produced from the wells and must be removed and broken before the crude oil stream can be further processed. In some of the emulsions, the water is very tightly bound and the process for its removal is costly. Chemical demulsifiers are commonly used, but add an additional cost to the recovered oil and their presence can interfere with downstream processes. These agents are typically hydrophilic surfactants and synthetic or natural flocculants. Examples are quaternary ammonium siloxanes, tannin, sodium silicate, sodium pentahydate, and high molecular weight amines, acrylamies, acrylic acids, acrylates, and acrylate salts.

The terms crude oil-water emulsion and crude oil emulsion are used for convenience in the following description and in the claims to mean a water-in-crude oil emulsion.

It is therefore an object of the present invention to provide an efficient and practical desulfurization process that is integrated with the demulsification of the crude oil.

It is a further object of the invention to provide a catalytic process for hydrodesulfurization that is promoted by microwave energy under relatively mild conditions of temperature and pressure.

SUMMARY OF THE INVENTION

The above objects and other advantages are obtained in the practice of the process of the invention which comprehends the addition of a hydrodesulphurization catalyst to a crude oil feedstream with sufficient agitation to form an intimate or homogeneous mixture, and thereafter subjecting the catalyst and crude oil mixture to a microwave energy source in the presence of hydrogen to initiate the hydrodesulfurization reaction. After the reaction is substantially complete, or after a predetermined time of reaction, the catalyst is separated from the mixture, as by gravity settling and/or filtration, and the crude oil containing hydrocarbons of lowered sulfur content and the sulfur-containing reaction product stream are recovered. Thereafter, the highly polar reaction products are removed by any known separation method or methods, such as liquid solvent separation.

The catalysts used in the process can be powdered iron, charcoal on iron, palladium oxide-silica based material, calcium oxide CaO, an alkali metal oxide catalyst, traditional hydrotreating catalysts, and combinations thereof. The alkali metal is selected from groups VIB and VIIIB of the periodic table and can include at least one metal selected from the group consisting of iron, palladium, nickel, cobalt, chromium, vanadium, molybdenum, tungsten, and a combination of metals such as nickel-molybdenum, cobalt-nickel-molybdenum, cobalt-molybdenum, nickel-tungsten, and nickel-tungsten-titanium.

The catalyst can be in the form of a nanocatalyst.

A high surface area activated carbon and other known microwave sensitizers are used to increase the microwave effectiveness.

The process of the invention can be conducted with a microwave source that emits radiation at a frequency that ranges from 200 MHz up to about 10,000 MHz and a power level of from about 100 watts to 10,000 watts, or 10 kw.

The time of exposure to the microwave radiation is determined by the parameters of power level, frequency, the catalyst(s) used, optimum maximum temperature of reaction, the physical form of the feedstream, e.g. thin film or flow-through bed, and the reaction kinetics, e.g. time required to achieve substantial completion of the hydrodesulfurization reaction. For a flow-through reactor, the process of the invention can be conducted with a space velocity in the range of 0.10 per hour to 10 per hour, and in a preferred embodiment in the range of 0.30 per hour to 3 per hour.

The hydrogen is maintained in the microwave treatment and reaction zone at a pressure ranging from one atmosphere to 400 psig. The temperature of the crude oil can range from 80° C. to 400° C., and is preferably in the range of from 200° C. to 250° C.

In a preferred embodiment, iron powder is mixed as a catalyst with crude oil and subjected to heating in the presence of hydrogen using a microwave energy source to perform a hydrodesulfurization reaction. In a particularly preferred embodiment, the microwave energy is applied to raise the temperature of the crude oil to about 200° C. while the sample is under a pressure of 50 psi of hydrogen. Application of the microwave energy is continued for about twenty minutes while maintaining the sample temperature at 200° C. which results in a 25% reduction in the level of sulfur. In a further preferred embodiment, the application of microwave energy is increased in duration by 50%, e.g., it is applied for thirty minutes, while maintaining the temperature of 200° C., resulting in a 27% level of desulfurization.

In a second preferred embodiment, the crude oil is mixed with a palladium oxide catalyst, diethanolamine as a polar additive, and a sensitizer under an atmosphere of hydrogen and subjected to irradiation by microwave. The resulting treated crude oil samples evidenced a sulfur reduction ranging from 16% to 39.4%.

The process is responsive to variations in the parameters of hydrogen pressure, final temperature to which the crude oil is heated and the length of time during which the crude oil is maintained at the end-point temperature by the application of microwave energy. The determination of these parameters to optimize the reaction is within the ordinary skill of the art.

In another aspect, the process of the invention comprehends treatment of an emulsion of water-in-crude oil, such as that produced from wells in which there has been a water incursion, or where the crude oil is being drawn from the reservoir rock at, or adjacent to one oil-water interface. In this further embodiment of the process of the invention, the crude oil-water emulsion is first subjected to microwave energy resulting in a breaking of substantially all of the foam of the emulsion and a release of all but about 3% of the water. The free water is separated for recovery and the resulting stream of crude oil contains about 3% of bound water; thereafter, a hydrodesulfurization catalyst is mixed with the crude oil and it is again subjected to microwave radiation in the presence of pressurized hydrogen as described above. After a predetermined reaction time, the treated crude oil stream is allowed to separate into a three-phase system consisting of an aqueous phase, a solid-containing phase and an upgraded crude oil phase, the latter being recovered as the desired end product. The catalyst can also be recovered and, if necessary, treated before being recycled for use in the process.

BRIEF DESCRIPTION OF THE DRAWINGS

The invention will be further described below with reference to the attached drawings in which the same numerals are used for like or similar elements, and in which.

DETAILED DESCRIPTION OF THE PREFERRED EMBODIMENTS

Figure 1:
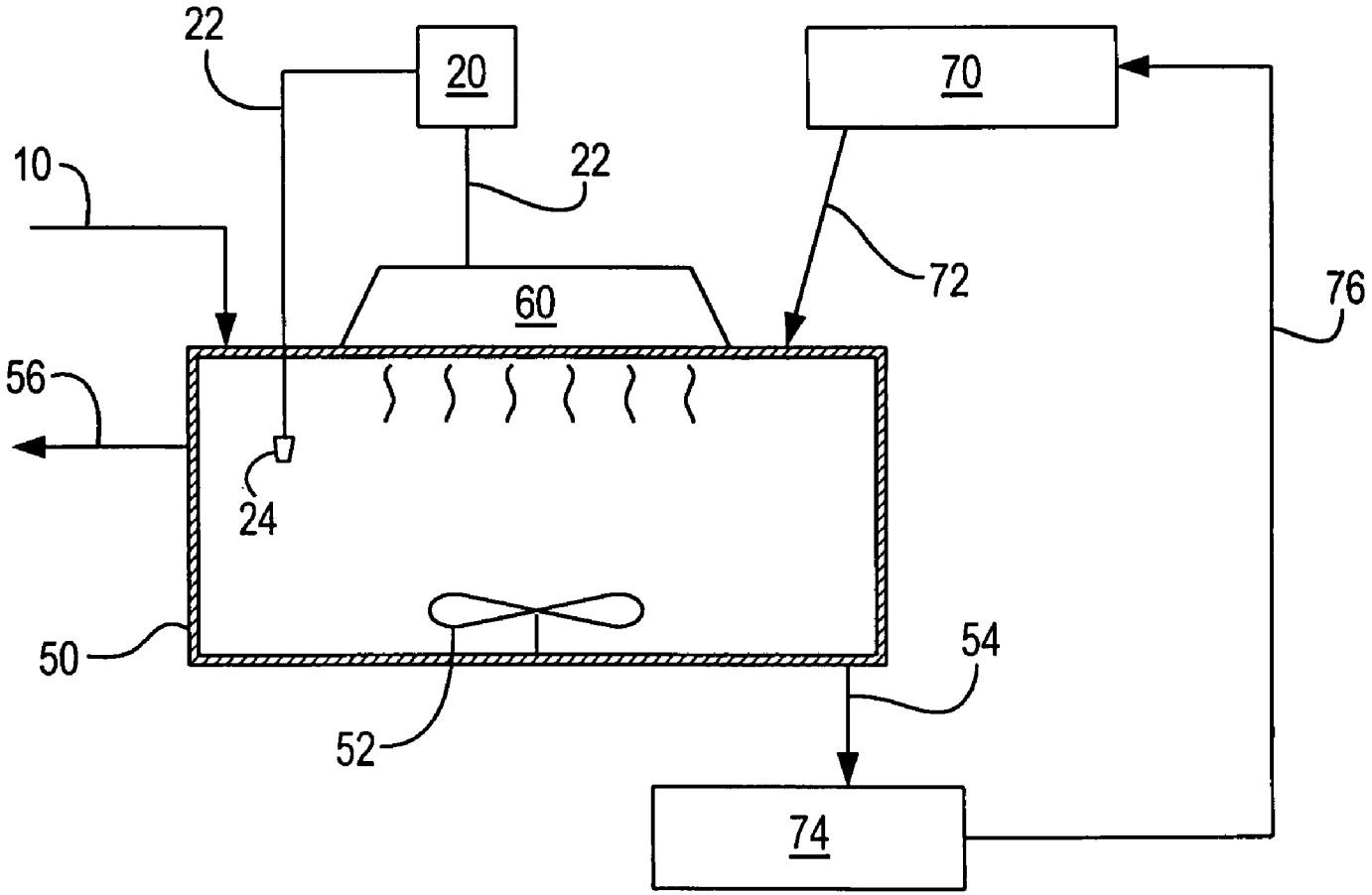
FIG. 1 is a schematic diagram illustrating a first embodiment for practicing the process of the invention.

Referring to FIG. 1, there is schematically illustrated an embodiment for the practice of the process of the invention in which a crude oil feedstream 10 is introduced into a vessel 50 comprising a microwave treatment zone that is equipped with appropriate mixing means 52 for intimately mixing the crude oil with a supply of catalyst 70 that is introduced via feedline 72. The schematic illustration of FIG. 1 represents a batch-type process; however, as will be apparent to one of ordinary skill in the art, the mixing and subsequent treatment steps can also be accomplished in a flow-through reactor.

With continuing reference to FIG. 1, a source of microwave energy 60 is appropriately positioned in the treatment zone of vessel 50. Once an appropriate and predetermined level of mixing has been achieved, the catalyst and crude oil mixture is subjected to microwave energy for a predetermined period of time. In a preferred embodiment, a programmable process controller 20 is provided with appropriate probes 24 and circuitry 22 to measure the temperature of the mixture and control the application of microwave energy from source 60 in order to achieve the desired rate of heating, maximum temperature and the overall time of exposure of the reaction to the microwave energy.

Following the completion of the reaction cycle and termination of the application of microwave energy, the mixing is discontinued and time is provided to allow the catalyst 70 to settle from the mixture to the bottom of vessel 50. Depending upon the nature of the catalyst material, gravity separation may have to be supplemented with a filtration step to effect recovery of the catalyst for recycling. Thereafter, a portion or all of the catalyst is withdrawn via outlet 54 and transferred to wet catalyst retaining vessel 74 where it can be washed, or otherwise processed as necessary in order to prepare it for recycling via conduit 76 to the storage vessel 70 in preparation for a subsequent batch processing.

The upgraded crude oil and the sulfur-containing reaction products are withdrawn via line 56 for further treatment and separation and recovery of the upgraded crude oil product.

Figure 2:
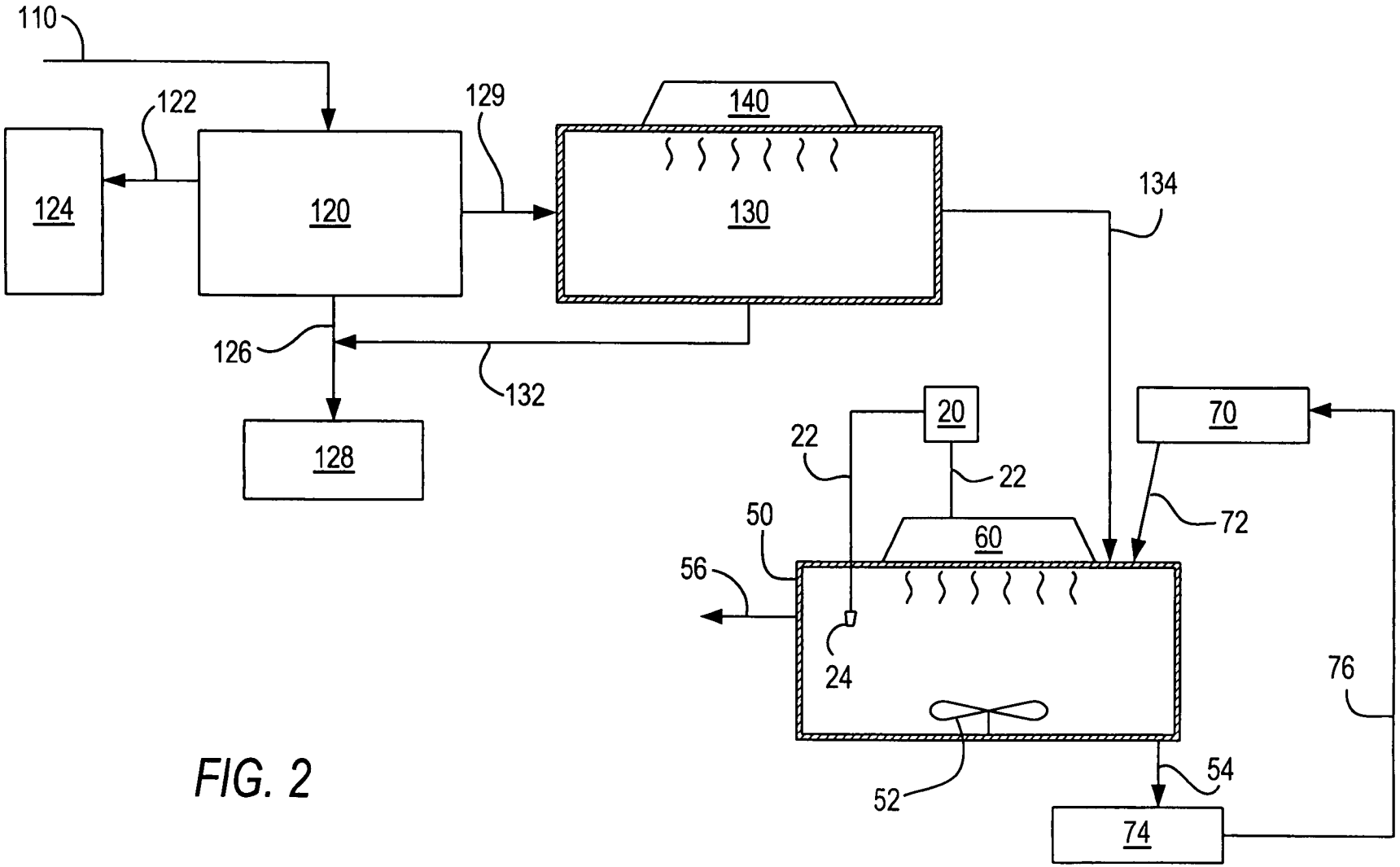
FIG. 2 is a schematic diagram illustrating a second embodiment of the process of the invention for treating a hard to break emulsion of water and oil.

A second embodiment of the process will be described with reference to the schematic illustration of FIG. 2 in which a difficult-to-break water-in-crude oil emulsion 110 is delivered to a first or primary settling tank 120 from which any free oil is recovered via conduit 122 for delivery to oil recovery vessel 124. Likewise, any free water is recovered from the bottom of first settling tank 120 via conduit 126 for delivery to recovery vessel 128. Some further processing of recovered water may be required to eliminate dissolved contaminants. The remaining emulsion is transferred via conduit 129 to a second settling tank 130 where it is exposed to a predetermined level of microwave energy from microwave source 140. As a result of this first treatment, substantially all of the emulsion is broken and the free water is removed from the bottom of settling tank 130 via conduit 132 for recovery in vessel 128.

The microwave treated oil contains approximately 3% of retained water and this product is transferred via conduit 134 to a second microwave treatment zone in vessel 50. Thereafter, the crude oil is mixed with catalyst 70 and subjected to microwave energy in accordance with the process steps described above in connection with FIG. 1. Note that the same numerals are applied to the various common elements and processing equipment in FIG. 2.

In a first series of tests demonstrating the process of the invention, a scientific monomode microwave apparatus sold by CEM Corporation of Matthews, N.C., USA under the trademark Discover System was employed. This system operates with a variable microwave power ranging from 0-300 W, the microwave energy being continuously focused on the sample in the range of from 1 to 50 ml, thus giving a high power density. The apparatus works in the pressure range of 0-300 psi (0-21 bar). Either 10 mL or 80 mL glass vessels can be used, the maximum working volumes being 5 mL and 60 mL, respectively. Vessels can be pre-pressurized with a reactive gas up to a pressure of 50 psi (3.5 bar). In a standard test, the apparatus was programmed to heat the reaction mixture from room temperature to the target temperature using a predetermined microwave power. Once reached, the microwave power is varied to maintain the desired temperature for a pre-determined period of time.

Reactions were performed in thick-walled glass vessels (capacity either 10 mL or 80 mL, maximum working volume 5 mL or 50 mL, respectively). The vessel was sealed with a septum having ports for pressure and temperature measurement devices. The pressure was controlled by a load cell connected directly to the vessel. The pressure limit was set to 200 psi for all reactions, beyond which the apparatus shuts down. The temperature of the contents of the vessel were monitored using a calibrated fiber-optic probe inserted into the reaction vessel by means of a sapphire immersion well. In all cases, the contents of the vessel were stirred by means of a rotating magnetic plate located below the floor of the microwave cavity and a Teflon-coated magnetic stir bar in the vessel. Gas was introduced directly into the reaction vessel and the pressure sensor was connected to the vessel in parallel. As a result, the exact loading pressure can be monitored in real time.

The reaction vessel was loaded with catalyst and crude oil or other sample before being placed into the microwave cavity and sealed with the septum. The vessel was pre-pressurized with hydrogen gas. The contents of the vessel were stirred to thoroughly mix the catalyst with the crude oil or model sample. Microwave energy was applied to heat the contents to the target temperature using an initial microwave power of 300 W and held at this temperature until the desired reaction time had elapsed. Upon cooling, the contents of the vessel were removed, allowed to stand and then analyzed for sulfur content.

The effects of microwave irradiation on petroleum ether solutions of benzothiophene and dibenzothiophene and a sample of crude oil were tested. The two thiophenic compounds were chosen as model compounds because they are commonly found in crude oil and are particularly challenging to desulfurize, being referred to as refractory compounds. When solutions (15 ml) containing each of these compounds was irradiated with microwave energy at 300 W they were not efficiently heated, reaching only 60° C. after 10 minutes of microwave heating. When the same test was performed using a 15 mL sample of crude oil a temperature of 120° C. was achieved after 10 minutes of microwave heating. Due to the low polarity of all the materials, they did not respond effectively to heating by microwave energy.

Since the addition of ionic materials to an otherwise non-microwave adsorbent mixture can greatly enhance the heating characteristics, the effects of performing EDS using two commercially available catalysts were tested. Molyvan 855 is an organomolybdenum-containing material with uses as varied as a friction reducer or antioxidant. Katalco 41-6 is a cobalt/molybdenum-containing material with known applications in conventional desulfurization processes. Microwave irradiation on solutions of dibenzothiophene in petroleum ether containing each of the two catalyst candidates was undertaken. It was observed that heating of the reaction mixtures was significantly more effective than in the absence of the metal complexes, suggesting that the overall polarity of the mixture was higher.

Desulfurization test reactions of dibenzothiophene under an atmosphere of hydrogen with the two catalysts were performed. For each test, the reaction vessel was loaded with dibenzothiophene, petroleum ether and, respectively, Molyvan 855 or Katalco 41-6. Before sealing, the reaction vessel was purged twice with hydrogen and pressurized with hydrogen to 50 psi. Each of the reaction mixtures were irradiated with 300 W microwave energy to a target temperature of 150° C. where they were held for a total lapsed time of 20 minutes. Upon analysis of the product mixture, it was found that little desulfurization had occurred. See Table 1 below, entries 1 and 2. Repeating the experiments using crude oil in place of dibenzothiophene as the substrate yielded similar results in the case of Molyvan 855, namely, limited desulfurization (Table 1, entry 3). With Katalco 41-6, a 5% desulfurization was observed. It appears that the low levels of HDS are due to the poor heating characteristics of the reaction mixtures and low activity of the Molyvan 855 or Katalco 41-6 under these conditions.

To overcome the poor heating characteristics of the mixtures, the reactions were repeated with the addition of a silicon carbide passive heating element. Silicon carbide (SiC) heats very rapidly and efficiently in a microwave field. The purpose was to see if, by increasing the bulk reaction temperature, the level of HDS could be increased. Using the SiC heating element, the reaction mixture was heated to the target temperature of 200° C., but no increase was observed in HDS activity of either Molyvan 855 or Katalco 41-6, indicating that these catalysts exhibit only a low level of activity under these reaction conditions.

The use of hydrogen donors such as metal hydrides in addition to, or in place of molecular hydrogen in HDS chemistry have been reported. Metal hydrides such as lithium aluminum hydride ($LiAlH_4$) or barium hydride ($BaH_2$) or calcium hydride ($CaH_2$) have been used in preparative organic chemistry as reducing agents. Their use in HDS as molecular hydrogen surrogates is limited due to the fact that they must be used in stoichiometric quantities. Test reactions were performed using $LiAlH_4$ and $CaH_2$ as hydrocarbon donors in microwave-promoted HDS reactions. Low levels of desulfurization were observed in the dibenzothiophene or crude oil samples (Table 1, entry 5-8). This may be due, in the case of crude oil, to the fact that metal hydrides are highly water sensitive and the difficulty of drying the crude oil to a level that it can be reliably used as a substrate. In addition, even when used in conjunction with molecular hydrogen, metal hydrides are less than convenient to use as catalysts for HDS reactions.

TABLE 1

Microwave-promoted HDS using Molyvan 855 and Katalco 41-6 and metal hydrides as catalyst candidates.

| entry | catalyst candidate | substrate | level of desulfurization (%) |
|---|---|---|---|
| 1 | Molyvan 855 | dibenzothiophene | <1 |
| 2 | Katalco 41-6 | dibenzothiophene | <2 |
| 3 | Molyvan 855 | crude oil | 1 |
| 4 | Katalco 41-6 | crude oil | 5 |
| 5 | $LiAlH_4$ | dibenzothiophene | 1 |
| 6 | $CaH_2$ | dibenzothiophene | 5 |
| 7 | $LiAlH_4$ | crude oil | no observed reaction |
| 8 | $CaH_2$ | crude oil | no observed reaction |

Metal powders have been reported to be effective as reagents for the desulfurization of coal pitch when used in conjunction with microwave heating which involved irradiating samples with short pulses of high energy microwave irradiation. In accordance with the present invention, iron powder was found to be useful as a catalyst for HDS of benzothiophene. Reactions were undertaken using an initial microwave power of 300 W to reach a target temperature of 200° and then maintained for a total reaction time of 20 minutes. An 8% desulfurization was obtained. Data is presented in Table 2, below. A $^1$H-NMR spectrum of the product mixture showed the formation of significant quantities of aromatic hydrocarbons in addition to untreated dibenzothiophene indicating formation of sulfur-free compounds.

The reaction using iron powder was repeated under the same conditions using crude oil. A 25% desulfurization was obtained. It was noted that the crude oil sample reached the target temperature significantly faster than the dibenzothiophene in petroleum ether. The initial level of sulfur in the crude oil was significantly less than that in the test solution of dibenzothiophene, and the crude oil contained a number of different sulfur-containing compounds, many of which may undergo a more facile HDS reaction than dibenzothiophene.

A larger sample of crude oil to which iron powder was added as a catalyst was prepared and aliquots were subjected to a series of tests. The effect of varying the bulk temperature, reaction time and pressure of hydrogen on the reaction are reported in Table 2. Initial reactions used a hydrogen pressure of 50 psi. Lowering this to 20 psi resulted in a reduction of the quantity of sulfur effectively removed from the crude oil sample. In the absence of hydrogen, no significant desulfurization was observed. These tests indicate that the optimal hydrogen pressure is 50 psi, or 3.4 atm, which is significantly lower than that used for conventional HDS reactions. Increasing the temperature from 250° C. had little effect on the HDS reaction. Extending the reaction time to 30 minutes produced a small, but measurable increase in the level of desulfurization to 27%. These tests demonstrate that the catalytic hydrodesulfurization process of the invention can be achieved under relatively mild conditions.

As noted above, when using the scientific microwave apparatus, reaction mixtures are heated to a target temperature and held there for a predetermined period of time. When heating the mixture from room temperature to the target point of 200° C., significant microwave power is used. Once the desired temperature is reached, the microwave power is varied in order to maintain the reaction mixture at a constant temperature. The power used to thereafter maintain the reaction mixture desired at the end temperature depends on the microwave absorptivity of the mixture and often is very low.

It has been reported in the literature that reactions may be complete by the time the reactants reach the target temperature, i.e., most of the reaction take place during the period when significant microwave power is applied. In order to obtain data on the reaction kinetics, the HDS reaction was repeated using iron powder as a catalyst at an initial microwave power of 200 W and the microwave irradiation was stopped once the target temperature of 200° C. had been reached, which in this case was 110 seconds. A 7% desulfurization was observed indicating that significant HDS has taken place by the time the mixture reaches the temperature end point. The fact that the reaction is not complete in this period suggests that both microwave power and bulk temperatures are important factors in the HDS process of the invention.

TABLE 2

Microwave-promoted HDS using iron powder as a catalyst.

| entry | substrate | reaction conditions | level of desulfurization (%) |
|---|---|---|---|
| 1 | dibenzothiophene | 50 psi $H_2$, heat to 200° C., 20 min | 8 |
| 2 | crude oil | 50 psi $H_2$, heat to 200° C., 20 min | 25 |
| 3 | crude oil | 20 psi $H_2$, heat to 200° C., 20 min | 10 |
| 4 | crude oil | no $H_2$, heat to 200° C., 20 min | no observed reaction |
| 5 | crude oil | 50 psi $H_2$, heat to 250° C., 20 min | 24 |
| 6 | crude oil | 50 psi $H_2$, heat to 200° C., 30 min | 27 |
| 7 | crude oil | 50 psi $H_2$, heat to 200° C., 110 s | 7 |

Another series of tests were conducted in a domestic microwave oven which was modified to accommodate high temperature and moderate pressure reactors, a mixing device, and a device for reconstitution of volatile fractions. Provision was also made for monitoring the temperature and pressure of the process.

Arab heavy crude was mixed with one or more of hydrogen, light hydrocarbon liquids, polar additives, hydrotreating catalysts, and microwave sensitizers, and the samples were exposed to various dosages of microwave radiation at low pressure. The selection of microwave sensitizers was based on their dielectric constant obtained from the literature. The power level and irradiation intensity was at the maximum level, indicated on the microwave oven as Power Level 10. The maximum irradiation period was 25 minutes. Ethanolamines were used as polar additives to determine their effect on desulfurization and on the microwave radiation characteristics of the heavy crude oil.

The physical properties of the original Arab heavy crude oil, identified as "AH50" in the tables, were determined. The API gravity was measured by hydrometer to be 27.31, with a sulfur content of 3.066 percent and a viscosity of 34.84 cSt at 25.2° C.

The heavy crude oil was mixed with 5 and 10 percent of various proportions of hydrocarbon additives, catalysts and microwave sensitizers. These samples were subjected to microwave irradiation for different time periods.

The power level and irradiation intensity was at the maximum power level, PL10, and the maximum irradiation period was 25 minutes as indicated in Tables 3 and 4, below. The non-irradiated sample was also pressurized with pure hydrogen gas at 20 atm and 30 atm, and then heated in a high pressure steel reactor and maintained at 84.5° C. and 100° C. respectively for 30 minutes over a palladium-silica based catalyst. The results of sulfur analyses are given in Table 3 for heavy oil and Table 4 for the fractions.

TABLE 3

Sulfur content analysis for desulfurized AH50

| Samples | Temp ° C. | Irradiation time (mins) | Sulfur content (%) | % Sulfur reduction |
|---|---|---|---|---|
| Heavy oil (AH50) only | — | — | 3.066 | — |
| AH50-PM (10%)$H_2$ = 20 atm | 84.5 | Autoclave heating | 3.011 | 1.8 |
| AH50-PM (10%)$H_2$ = 30 atm | 100 | Autoclave heating | 3.012 | 1.8 |
| AH50-PM (5%)$H_2$ = 20 atm | 84.5 | Autoclave heating | 2.997 | 2.3 |
| Heavy oil (AH50) only | 191.5 | 20 | No observation | — |
| AH50 + 1.5 g Palladium cat | 228.8 | 25 | 3.06 | No change |
| AH50 + 10% Charcoal on cat | 243.7 | 25 | No observation | — |
| AH50 + 10% DEA + 15% Charcoal on cat | 381.6 | 25 | 2.574 | 16.1 |
| AH50-(10% DEA) AH50-(5% DEA) | 193.6 | 25 | 2.031 | 33.8 |
| AH50 + PM10 | | 10 | 1.858 | 39.4 |

TABLE 4

Sulfer content analysis for irradiated and non-irradiated AH50 fractions.

| Distillation Fraction (50 ml) | Temp (° C.) | Irradiation Time (mins) | Mass of Distillate (g) | Non-Irradiated | Mass % Sulfer Irradiated sample with 10% DEA, 15% charcoal cat. |
|---|---|---|---|---|---|
| 1 | 154.5-250.0 | 10 | 6.75 | 1.859 | 0.9624 (48.3%) |
| 2 | 260.0-306.2 | 10 | 3.96 | 0.3110 | 0.1902 (38.8%) |
| 3 | 318.2-380.1 | 13 | 7.23 | 0.9030 | 0.8128 (10%) |

TABLE 4-continued

Sulfer content analysis for irradiated and non-irradiated AH50 fractions.

| Distillation Fraction (50 ml) | Temp (° C.) | Irradiation Time (mins) | Mass of Distillate (g) | Non-Irradiated | Mass % Sulfer Irradiated sample with 10% DEA, 15% charcoal cat. |
|---|---|---|---|---|---|
| 4 | 396.4-452.2 | 25 | 18.31 | 2.528 | 2.506 (0.89%) |
| Residue | — | n/a | 12.34 | — | — |
| Losses | — | n/a | 1.41 | — | — |

The change in the sulfur content for the samples that were subjected to high pressure hydrogenation reaction in a conventional reactor was negligible, between 1.8% and 2.3% as shown in Table 3. In consideration of the required process conditions for hydrodesulfurization discussed above, it is apparent that the low temperatures did not achieve a significant reduction in the sulfur content of the heavy oil. However, the results indicate that ethanolamine is effective as a desulfurization agent for sour crude oil. The irradiated samples containing ethanolamine, sensitizer, and catalyst result in a reduction in sulfur content of between 16% and 39.4% as reported in Table 3. The desulfurization was not as significantly influenced by high temperature as it was with irradiation periods, where the optimum period was 10 minutes for 39.4% desulfurization. The distillation fractions of the pure original heavy oil, AH50, were irradiated for different times between 10 and 25 minutes with ethanolamine and charcoal. As reported in Table 4, the sulfur content of the light distillates were reduced to 39% and 48%, while those of heavy distillates were reduced to 0.9% and 10%.

The highest temperature achieved when charcoal was the sensitizer was 381.6° C., using AH50 with 10% ethanolamine and 15% charcoal on iron oxide catalyst, and irradiated for 25 minutes. The GC-MS spectra of this sample showed a noticeable change in molecular structure when compared to the spectra for the pure crude.

There was an evident shift in the peaks of the chromatogram of this sample compared to that of the original heavy crude and other samples with lower reaction temperatures. These results suggest that the molecular structure of the sample was changed and higher molecular weight hydrocarbon chains were formed through bonding.

When using charcoal on iron oxide catalyst, the highest temperature of 381.6° C. was obtained approximately 10 minutes into the test. Once this temperature was achieved, it decreased to 346.1° C. over the next 15 minutes. The extra irradiation time allowed the reaction to proceed further causing the hydrocarbons to bond and create a higher molecular weight material. It appears that the optimum microwave irradiation time for this sample is 10 minutes which is when the highest temperature was reached. Breaking of the heavier hydrocarbons can be theorized.

These results show that catalytic hydrodesulfurization of crude oil using microwave energy in the presence of hydrogen can be affected under relatively mild conditions of temperature and pressure. The process of the invention can also be advantageously combined with the preliminary treatment of hard-to-break water and oil emulsions to obtain a demulsified crude oil feed stream containing a low percent of retained water that can then be subjected to the microwave-promoted hydrodesulfurization process.

The process of the invention efficiently recovers oil from a water-in-oil emulsion of crude oil, where the organic acids, asphaltenes, basic sulfur- and nitrogen-containing compounds and solid particles present in the crude oil form a film at the water/oil interface, while simultaneously treating the oil with microwave energy in the presence of one or more catalysts and a pressurized hydrogen atmosphere to reduce its sulfur content and thereby enhance its value.

A suitable system for the second stage microwave treatment is available from Milestone srl, having offices at Via Fatebenefratelli, Italy and 25 Controls Drive, Shelton, Conn. 06484. A suitable on-line crude oil monitoring device having a sensor that detects the layer thickness of the upper and lower phases with a guided microwave device is sold under the trademark VEGALFX 67 by VEGA Australia Pty Ltd, A.B.N. 55003-346-905, 398 The Boulevard Kirrawee, NSW 2232, Australia.

Specific catalysts and reaction conditions have been identified and demonstrated to illustrate the process of the invention. Further modifications will be apparent to those of ordinary skill in the art from this description and the scope of the invention us to be determined by the claims that follow.

The invention claimed is:

1. A process for upgrading a sulfur-containing crude oil feedstream to improve the API gravity and reduce the sulfur content, the process comprising:

a. mixing the crude oil with one or more hydrotreating catalysts to provide a catalyst-crude oil reaction mixture;

b. irradiating the reaction mixture with microwave energy at a power level of from about 100 watts to about 10,000 watts for an exposure time of up to 30 minutes in the presence of hydrogen at a pressure ranging from one atmosphere to 300 psig to raise the temperature of the reaction mixture to a range of from 200° C. to 250° C.;

c. maintaining the temperature of the reaction mixture for said exposure time to form a hydrodesulfurized mixture;

d. separating the hydrodesulfurized mixture into a catalyst-containing solid phase and a liquid phase containing a hydrodesulfurized crude oil and sulfur-containing compounds; and e. recovering the hydrodesulfurized crude oil.

2. The process of claim 1, wherein the one or more catalysts is selected from the group consisting of powdered iron, palladium oxide, calcium oxide, an alkali metal oxide catalyst, traditional hydrotreating catalysts, and combinations thereof.

3. The process of claim 1, wherein the hydrotreating catalyst comprises at least one metal selected from Groups VIB and VIIIB of the Periodic Table.

4. The process of claim 3 in which the at least one metal is selected from the group consisting of iron, palladium, nickel, cobalt, chromium, vanadium, molybdenum, tungsten, a combination of metals such as nickel-molybdenum, cobalt-nickel-molybdenum, cobalt-molybdenum, nickel-tungsten and nickel-tungsten-titanium.

5. The process of claim 1 that includes adding a polar compound to the mixture of crude oil and catalyst in step (a).

6. The process of claim 5, wherein the polar compound is an ethanolamine.

7. The process of claim 1 which includes adding activated carbon to the mixture of step (a).

8. The process of claim 1, wherein the microwave energy is at a frequency of from about 200 MHz to about 10,000 MHz.

9. The process of claim 1, wherein the power level is from 500 watts to 5,000 watts and the exposure time is between 20 and 25 minutes.

10. The process of claim 1, wherein the reaction is carried out in a flow-through reactor at an hourly space velocity of the liquid phase that is in range of from 0.10 per hour to 10 per hour.

11. The process of claim 10, wherein the liquid phase hourly space velocity is in the range from 0.30 per hour to 3 per hour.

12. The process of claim 1 in which the crude oil feedstream includes both bound and free water, the process comprising the additional preliminary steps of:

i. separating the crude oil feedstream into free water and a water-in-crude oil emulsion containing only bound water;

ii. separating any free crude oil from the emulsion;

iii. irradiating the emulsion with microwave energy to substantially break the emulsion;

iv. separating the free water from the broken emulsion to provide oil containing less than 3% bound water, and thereafter performing steps (a)-(e).

13. The process of claim 1 in which a polar compound and microwave sensitizer is added to the mixture of crude oil and catalyst in step (a).

14. The process of claim 12, wherein the one or more catalysts is selected from the group consisting of powdered iron, palladium oxide, calcium oxide, an alkali metal oxide catalyst, traditional hydrotreating catalysts, and combinations thereof.

15. The process of claim 12, wherein the hydrotreating catalyst comprises at least one metal selected from Groups VIB and VIIIB of the Periodic Table.

16. The process of claim 15 in which the at least one metal is selected from the group consisting of iron, palladium, nickel, cobalt, chromium, vanadium, molybdenum, tungsten, a combination of metals such as nickel-molybdenum, cobalt-nickel-molybdenum, cobalt-molybdenum, nickel-tungsten and nickel-tungsten-titanium.

17. The process of claim 12 that includes adding a polar compound to the mixture of crude oil and catalyst in step (a).

18. The process of claim 17, wherein the polar compound is an ethanolamine.

19. The process of claim 12 which includes adding activated carbon to the mixture of step (a).

20. The process of claim 12, wherein the microwave energy is at a frequency of from about 200 MHz to about 10,000 MHz.

21. The process of claim 12, wherein the power level is from 500 watts to 5,000 watts and the exposure time is between 20 and 25 minutes.

22. The process of claim 12, wherein the reaction is carried out in a flow-through reactor at an hourly space velocity of the liquid phase that is in range of from 0.10 per hour to 10 per hour.

23. The process of claim 22, wherein the liquid phase hourly space velocity is in the range from 0.30 per hour to 3 per hour.

* * * * *